US009696088B2

(12) United States Patent
Böhn et al.

(10) Patent No.: US 9,696,088 B2
(45) Date of Patent: Jul. 4, 2017

(54) DRYER FOR A TEXTILE PRODUCT WEB

(71) Applicant: Trützschler GmbH & Co. KG, Mönchengladbach (DE)

(72) Inventors: Markus Böhn, Hainburg (DE); Stephan Hajdu, Rödermark (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 0 days.

(21) Appl. No.: 14/432,736

(22) PCT Filed: Jul. 5, 2013

(86) PCT No.: PCT/EP2013/001979
§ 371 (c)(1),
(2) Date: Mar. 31, 2015

(87) PCT Pub. No.: WO2014/060056
PCT Pub. Date: Apr. 24, 2014

(65) Prior Publication Data

US 2015/0267965 A1 Sep. 24, 2015

(30) Foreign Application Priority Data

Oct. 17, 2012 (DE) ..... 10 2012 109 878

(51) Int. Cl.
*F26B 13/16* (2006.01)
*F26B 21/02* (2006.01)

(52) U.S. Cl.
CPC ..... *F26B 13/16* (2013.01); *F26B 21/02* (2013.01)

(58) Field of Classification Search
CPC ..... F26B 13/16; F26B 19/00; F26B 21/00; F26B 21/02; F26B 21/06; D06F 58/00; D06F 58/08; D06F 58/20
USPC ..... 34/380, 413, 465, 601, 117; 68/5 C, 5 R, 68/19, 20; 134/58 D; 162/11, 117, 205
See application file for complete search history.

(56) References Cited

U.S. PATENT DOCUMENTS 3,065,551 A 11/1962 Cohn et al.
3,581,411 A * 6/1971 Catallo ..... F26B 13/16 34/115
3,727,325 A * 4/1973 Fleissner ..... D06B 19/0041 26/90
3,811,988 A * 5/1974 Fleissner ..... D04H 3/14 156/311

(Continued)

FOREIGN PATENT DOCUMENTS

DE 1729499 A1 2/1972
DE EP 1586701 A1 * 10/2005 ..... D21F 5/02

(Continued)

OTHER PUBLICATIONS

PCT/ISA/210 for International Application No. PCT/EP2013/001979 dated Oct. 7, 2013.

*Primary Examiner* — Stephen M Gravini
(74) *Attorney, Agent, or Firm* — FisherBroyles, LLP; Robert Kinberg

(57) ABSTRACT

The invention relates to a dryer for a textile fabric web, comprising a dryer chamber (2) and having at least one drum (3*a*) which is arranged in the dryer chamber (2) and around at least part of which the fabric web (5) is wrapped, wherein heated drying air flows through the fabric web (5) and is discharged via an interior chamber of the drum (3*a*), characterized in that the dryer (1) has a separate additional compartment (10) via which fresh air (11) is supplied and exhaust air (13) is discharged.

17 Claims, 4 Drawing Sheets

(56) References Cited

U.S. PATENT DOCUMENTS 4,693,016 A * 9/1987 Yamazaki ..... F26B 13/16 34/115
5,669,155 A * 9/1997 Hughes ..... F26B 13/16 34/115
5,699,626 A * 12/1997 Chuang ..... D21F 5/143 34/453
5,787,602 A * 8/1998 Hsu ..... D21F 1/0027 34/116
5,974,691 A * 11/1999 Marchal ..... D21F 5/20 34/122
6,199,296 B1 * 3/2001 Jewitt ..... D21F 5/182 34/115
6,308,436 B1 * 10/2001 Stipp ..... D21F 5/006 34/422
6,405,418 B1 * 6/2002 Crouch ..... D06B 1/14 28/167
6,877,246 B1 * 4/2005 Hada ..... D21F 5/182 34/119
7,123,765 B2 * 10/2006 Carbone, II ..... G06T 7/0004 382/141
7,383,641 B2 * 6/2008 Fernandes ..... D21F 1/0027 162/361
9,096,079 B2 * 8/2015 Priebe ..... B41J 11/002
2015/0267965 A1 * 9/2015 Bohn ..... F26B 21/02 34/465

FOREIGN PATENT DOCUMENTS

DE 102007016958 A1 * 10/2008 ..... C11D 17/049
DE 102007043523 A1 * 3/2009 ..... D04H 1/48
DE 102009016019 A1 10/2010
DE 202011005041 U1 5/2012
EP 1211351 A2 * 6/2002 ..... D21F 5/182
GB 1208840 A 10/1970
JP 2004156200 A * 6/2004
WO WO 9713111 A1 * 4/1997 ..... F26B 13/16
WO WO 9923299 A1 * 5/1999 ..... D21F 11/006
WO 2012136802 A1 10/2012

* cited by examiner

DRYER FOR A TEXTILE PRODUCT WEB

BACKGROUND OF THE INVENTION

The invention relates to a dryer for a textile fabric web, and to a method of drying a textile fabric web.

For drying textile fabric webs, dryers are known in which one or more drums are arranged in a housing. A textile fabric web is supplied to the dryer via an opening in the dryer compartment, the textile fabric web being wrapped around a large part of the periphery of the drum and then being discharged from the dryer compartment again. Usually, fresh air is also supplied via this opening, the fresh air being heated inside the dryer compartment and mixed with the circulating air in order to be able to absorb the greatest possible amount of moisture. While the fabric web is wrapped around the drum, the mixture of circulating air and fresh air flows through the fabric web, absorbs at least some of the moisture of the fibre web and is discharged again via the interior chamber of the drum. A volumetric sub-flow from this volumetric flow is discharged as exhaust air, the moist exhaust air being discharged via channels above the drums, which as a result of the rotating drums requires elaborate and expensive sealing and a high level of maintenance. In order to avoid the suction effect from the environment of the dryer, there have subsequently been added to the dryer compartment supply lines or channels for fresh air which can be coupled, for example, to a heat exchanger for heating the fresh air.

A previously described dryer is disclosed in DE 10 2009 016 019 A1. In dryers of this design the circulation of the fresh air takes place at right angles to the withdrawal direction of the moist air, that is to say at right angles to the drum axis, with the result that the air circulation inside the dryer compartment is disrupted. A further disadvantage is that, for reasons of lack of available space, modification is often complicated and it is not possible to couple the fresh air channel to a heat exchanger. Since the dryers are positioned very close together in a row of different processing units that treat the textile fabric web in succession, there is often no room subsequently to install a channel for fresh air between the units.

DE 1 729 499 A1 discloses a perforated drum dryer having intermediate compartments arranged at the end faces of the perforated drums. Fresh air is fed to these intermediate compartments and mixed with the drying air. Some of the used exhaust air is discharged via the fan chamber. The intermediate compartment is fixedly integrated in the dryer housing and cannot be retrofitted with a heat exchanger.

SUMMARY OF THE INVENTION

The problem of the invention is to provide a dryer for a textile fabric web in which guidance of exhaust air and fresh air can be effected in a way that is advantageous in terms of flow behaviour, wherein it is also possible, if required, subsequently to install a heat exchanger.

In accordance with the technical teaching of the invention, the dryer for a textile fabric web comprises a dryer chamber having at least one drum which is arranged in the dryer chamber and around at least part of which the fabric web is wrapped, wherein heated drying air flows through the fabric web and is discharged via an interior chamber of the drum, wherein the dryer has a separate additional compartment via which fresh air is supplied and exhaust air is discharged.

The features of the invention make it possible for the connections for the fresh air and the exhaust air to be arranged on the dryer in such a way that the air flow for the drying process in the dryer chamber 2 and inside the drum is not disrupted. As a result of the additional compartment, the drying air expands, so that its flow speed on leaving the drum is several times lower. Withdrawal of the exhaust air from the additional compartment has only an extremely small effect on the drying process. Furthermore, as a result of the reduced pressure in the additional compartment the fresh air can be freely drawn in and conducted into the heating and fan chamber.

In an advantageous arrangement of the invention, the additional compartment is arranged between an end face of the dryer and a heating and fan chamber. For energy-related reasons, the removal of the exhaust air from the drying air in the additional compartment is at its most optimum, because here the drying air has its lowest energy level. Accordingly, the loss of energy through the exhaust air is at its lowest. This results in a solution which is advantageous to the drying process in terms of flow behaviour and which can be arranged between the units arranged one after the other, irrespective of the available space. In addition, the clearly defined interface allows the use of a heat recovery means under optimum conditions. The energy balance can therewith be further improved.

Inside the additional compartment, the fresh air mixes with the drying air. Due to the fact that means for heating the fresh air and drying air are arranged inside the heating and fan chamber, the heated drying air has to travel only a short way to the dryer chamber, during which it does not cool down.

An energy-efficient improvement is achieved by constructing the means in the form of heat exchangers, the heat exchangers utilising the exhaust air from the additional compartment to heat the fresh air and drying air.

The fresh air and exhaust air flowing in the additional compartment can be separated from one another by means for division into segments. The additional compartment can likewise be divided into segments analogously to the number of drums. The individual segments can be separated from one another by walls in order that there is no exchange of air between the segments. By division into partly permeable segments, for example in the form of perforated plates, the exhaust air or the fresh air can be distributed to a plurality of segments. This can likewise be effected by means of guide plates.

The arrangement of the fans at the heating and fan chamber for circulating the drying air has the advantage that the dryer can be of relatively compact construction.

Inside the additional compartment there are arranged connections through which the drying air can be extracted from the dryer chamber or from the drums by means of the fans. The connections can in turn be constructed in a way that is advantageous in terms of flow behaviour in order to minimise flow losses.

The method according to the invention for drying a textile fabric web is characterised by the steps of heating drying air and conducting it into a dryer chamber in which a fabric web is wrapped around at least part of at least one drum arranged inside the dryer chamber, wherein the heated drying air flows through the fabric web and is discharged via an interior chamber of the drum, wherein fresh air is supplied to a separate additional compartment and exhaust air is discharged via the additional compartment.

The additional compartment has no effect on the flow conditions inside the dryer chamber and the drum. On entering the additional compartment the exhaust air undergoes a significant reduction in flow speed, whereas as a result of the reduced pressure in the additional compartment the fresh air can be freely drawn in and conducted into the heating and fan chamber.

A circulation system is created in which a mass sub-flow of exhaust air is withdrawn from the drying air and a mass sub-flow of fresh air is supplied thereto, the exhaust air being removed from the drying air at the location at which the drying air has its lowest energy level, namely in the additional compartment.

BRIEF DESCRIPTION OF THE DRAWINGS

The invention is described in greater detail below with reference to a possible exemplary embodiment which is shown diagrammatically in the drawings, wherein.

DETAILED DESCRIPTION OF THE INVENTION

Figure 1:
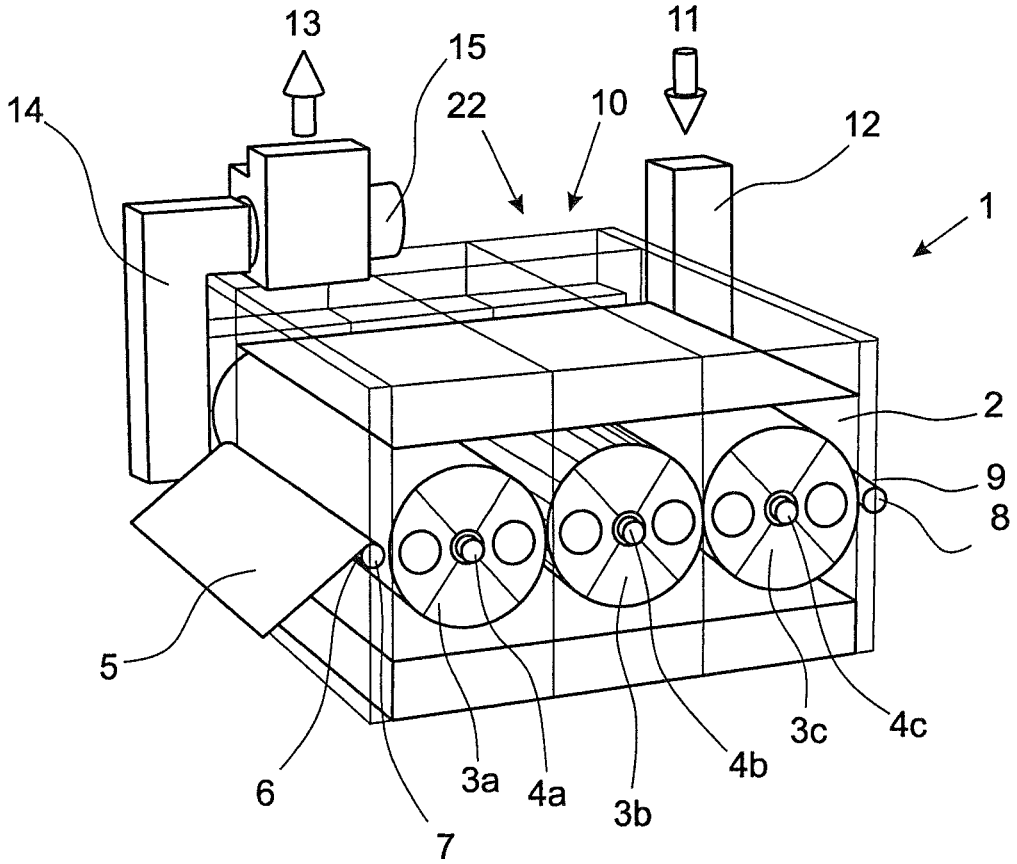
FIG. 1: is a diagrammatic front view of a serial dryer.

FIG. 1 shows a dryer 1 in the form of a serial dryer. Inside a dryer chamber 2, three drums 3*a*, 3*b*, 3*c* are arranged one after the other and with their axes 4*a*, 4*b*, 4*c* in a row. A fabric web 5 is guided into the dryer chamber 2 via an inlet 6. By means of a guide roller 7, the fabric web 5 is guided first under the first drum 3*a*, then above the second drum 3*b* and subsequently under the third drum 3*c*. By means of the guide roller 8, the fabric web 5 is guided out of the dryer chamber 2 through an outlet 9. Heated drying air flows through the fabric web 5 during its passage through the dryer chamber 2, the drying air absorbing the moisture of the fabric web 5 and being extracted via the interior of the drums 3*a* to 3*c*.

According to the invention, there is arranged at the dryer chamber 2 an additional compartment 10 into which the channel 12 for the fresh air 11 and the channel 14 for the exhaust air 13 open.

The additional compartment 10 is constructed so as to be fully distinct and separate from the dryer chamber 2. The heating and fan chamber 22 is arranged at the additional compartment 10. The dryer chamber 2 is connected to the heating and fan chamber 22 by air channels above and below the drums 3*a*-3*c*. The additional compartment 10 is connected to the dryer chamber 2 via the end-face openings of the drums 3*a*-3*c*.

Figure 2:
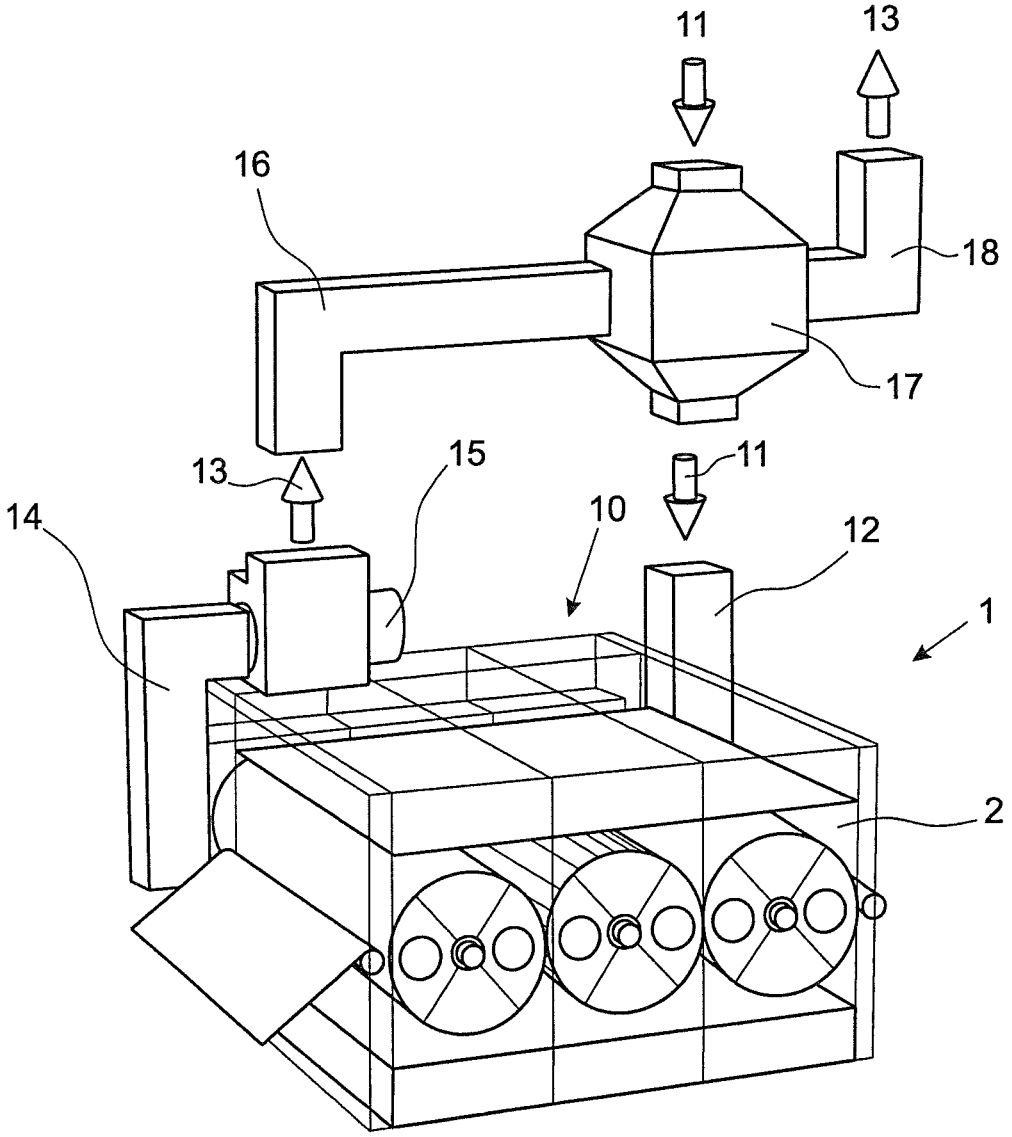
FIG. 2: is a view corresponding to FIG. 1 with a heat recovery means.

In FIG. 2, the dryer 1 from FIG. 1 is equipped with an optional heat recovery means. The same parts have been given the same reference numerals. On the housing of the fan 15 adjoining the channel 14 there is positioned a further channel 16 which causes the exhaust air 13 to flow through a further heat exchanger 17 and discharges it via a channel 18. The heat exchanger 17 is simultaneously connected to the channel 12, so that before the fresh air 11 flows into the additional compartment 10 it has already undergone an increase in temperature as a result of the heat exchanger 17. This optional retrofittable solution enables the thermal efficiency of the dryer 1 to be further increased.

Unlike the prior art, here the fresh air 11 does not flow directly into the dryer 1, but first flows into the additional compartment 10 in which further heating takes place as a result of mixing with the drying air after it has flowed through the fabric web 5. In previous designs, such intermixing of the fresh air with the drying air took place before flowing through the fabric web 5, thus influencing the temperature of the drying air before the fabric web 5. Utilising the difference in temperature between exhaust air 13 and fresh air 11 is sufficient to bring about a further increase in the thermal efficiency of the dryer 1.

Figure 3:
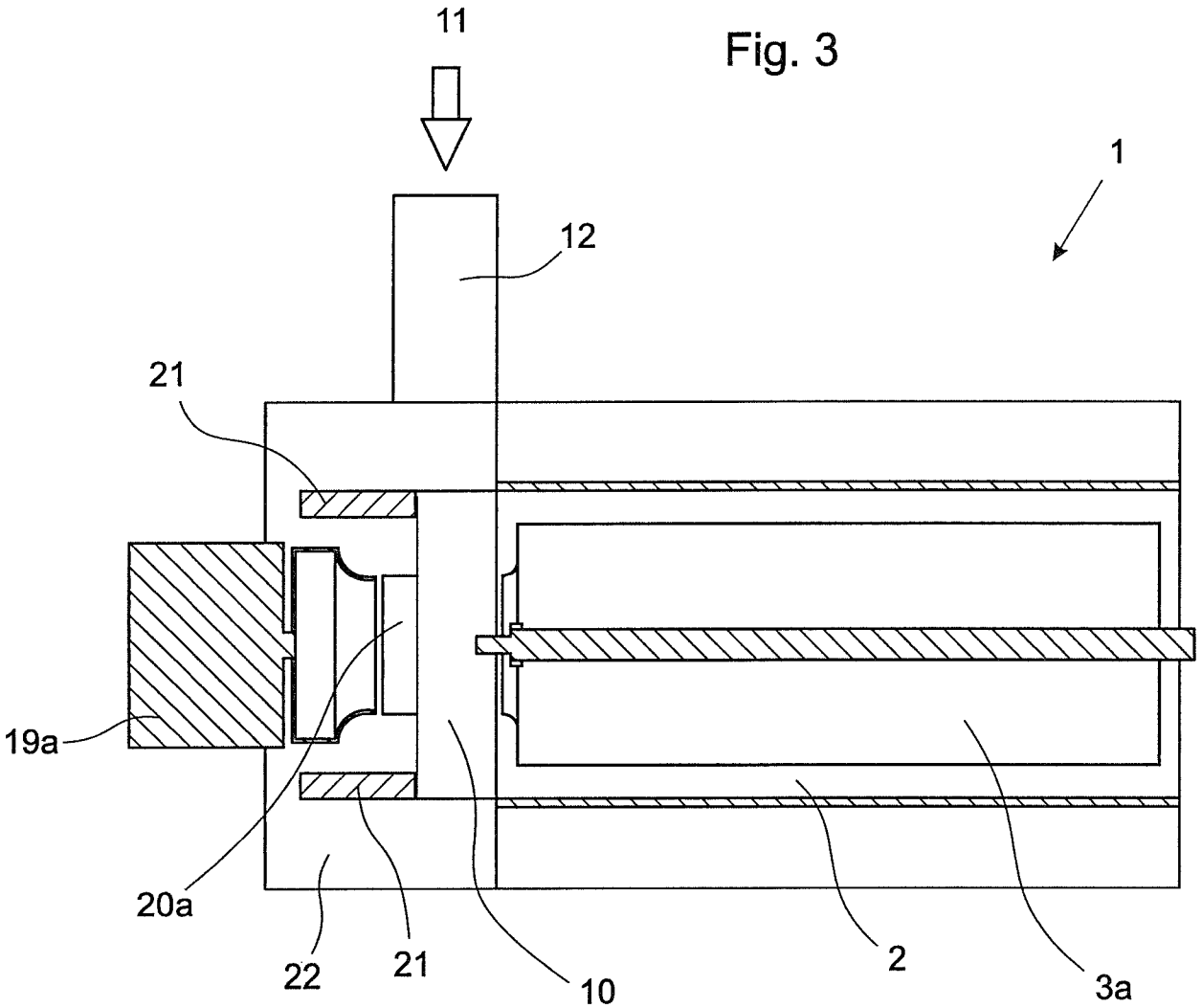
FIG. 3: is a side view in section of the serial dryer according to the invention.

FIG. 3 shows a lateral section through a dryer 1. The fans 19*a*-19*c*, which extract the moisture-saturated drying air from the drums 3*a*-3*c*, are flange-mounted on the heating and fan chamber 22 and are connected to the additional compartment 10 via connections 20*a*-20*c* or adapters. On the opposite side, the drums 3*a*-3*d* are likewise connected to the additional compartment 10 via connections. The drying air flows out of the drums 3*a*-3*c* into the additional compartment 10 and from the additional compartment 10 via the connections 20*a*-20*c* into the extraction cross-section of the respective fans 19*a*-19*c*. In the region of the drum 3*a*, the exhaust air is removed from the additional compartment 10 via a channel 14 which is arranged at the end face (see FIGS. 1 and 2). At the end of the channel 14, a fan 15 provides the necessary air flow. The fresh air supply is effected in the region of the drum 3*c* via the additional compartment 10 to which the channel 12 is connected at the end face.

As a result of the additional compartment 10, the drying air expands, so that its flow speed on leaving the drum 3*a*, 3*b*, 3*c* is several times lower. Furthermore, as a result of the reduced pressure in the additional compartment 10, the fresh air 11 can be freely drawn in and thereby supplied to the heating and fan chamber 22 with drying air.

Inside the heating and fan chamber 22 there can be arranged heating elements 21 in the form of heat exchangers, one or more gas heaters or electric heaters, which heat the discharged drying air 11, including the fresh air, to the drying temperature.

Figure 4:
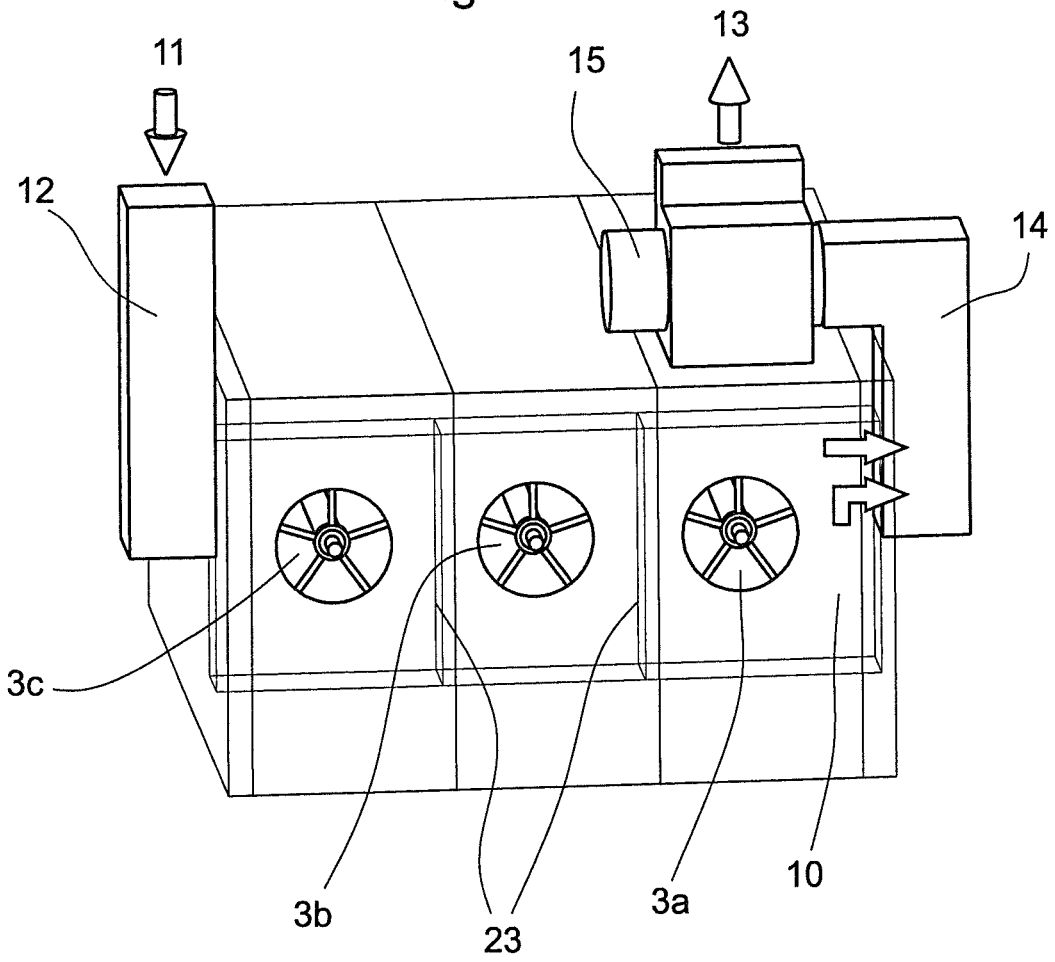
FIG. 4: is a rear view of the serial dryer with the heating and fan chamber removed.

FIG. 4 shows a rear view of the dryer 1, in which the heating and fan chamber 22 have been omitted. Here it is possible to see the openings of the drums 3*a*-3*c* via which the drums 3*a*-3*c* are connected to the additional compartment 10 by means of connections. The fresh air 11 is introduced into the additional compartment 10 via a channel 12. Inside the additional compartment 10 there are arranged separating plates 23 in the form of perforated plates which divide the additional compartment 10 into segments, so that it is possible to influence the distribution of the fresh air to the individual fans 19*a*-19*c*. It is likewise possible, by means of guide plates (not shown), to influence the distribution of the fresh air inside the additional compartment 10, for example to separate it from the exhaust air.

From the additional compartment 10, by means of the fans 19*a*-19*c* the mixture of fresh air and drying air flows into the heating and fan chamber 22. This is a circulation system from which a mass sub-flow in the form of exhaust air is withdrawn and to which a mass sub-flow in the form of fresh air is supplied.

The heating and fan chamber 22 is arranged as a separate compartment in the region of the rear end face of the dryer 1, the additional compartment 10 being arranged in between. The drive means of the fans 19*a*, 19*b*, 19*c* are arranged outside the heating and fan chamber 22, the fan impellers are located inside. Each fan 19*a*, 19*b*, 19*c* is associated with a drum 3*a*, 3*b*, 3*c*. The fans 19*a*, 19*b*, 19*c* are connected via connections 20*a*-20*b* or adapters to the additional compartment 10 and the latter is connected, likewise via connections or adapters, to the drums 3*a*, 3*b*, 3*c*.

REFERENCE NUMERALS

1 dryer
2 dryer chamber
3*a, b, c* drum
4*a, b, c* axis
5 fabric web
6 inlet
7 guide roller
8 guide roller
9 outlet
10 additional compartment
11 fresh air
12 channel
13 exhaust air
14 channel
15 fan
16 channel
17 heat exchanger
18 channel
19*a, b, c* fan
20*a, b, c* connection
21 heating element
22 heating and fan chamber
23 separating plate

The invention claimed is:

1. A dryer for a textile fabric web, comprising:

a dryer chamber having an end face:

at least two drums arranged parallel to each other in the dryer chamber, each drum having an interior chamber, the fabric web being wrapped around at least part of each drum, wherein heated drying air flows through the fabric web and is discharged via the interior chamber of each drum;

a heating and fan chamber; and a separate additional compartment arranged between the end face of the dryer chamber and the heating and fan chamber, and extending across ends of the drums, wherein fresh air is supplied and exhaust air is discharged via the separate additional compartment, the separate additional compartment includes a single channel for fresh air and a single channel for exhaust air, and the fresh air is mixed with the drying air inside the separate additional compartment after the drying air passes through the fabric web.

2. The dryer according to claim 1, further comprising at least one of means for distributing the fresh air, means for separating the exhaust air from the fresh air and means for dividing the additional compartment into segments, arranged inside the additional compartment.

3. The dryer according to claim 2, wherein the at least one means comprise separating plates or guide plates.

4. The dryer according to claim 1, wherein ends of the drums have end face openings and the drying air is discharged into the additional compartment via the end-face openings of the drums.

5. The dryer according to claim 1, further comprising fans for extracting the exhaust air from the dryer chamber arranged at the heating and fan chamber.

6. The dryer according to claim 5, wherein the heating and fan chamber is connected to the additional chamber via connections.

7. The dryer according to claim 1, wherein the heating and fan chamber is connected to the dryer chamber via air channels.

8. The dryer according to claim 1, further comprising a heat exchanger arranged outside the additional compartment that uses the exhaust air withdrawn from the drying air to heat the fresh air.

9. The dryer according to claim 1, further comprising means for heating the drying air arranged inside the heating and fan chamber.

10. The dryer according to claim 9, wherein the means for heating the drying air comprises one of a heat exchanger, a gas burner, or an electric heater.

11. A method of drying a textile fabric web, comprising:

heating and conducting drying air into a dryer chamber in which a fabric web is wrapped around at least part of at least two drums arranged inside the dryer chamber and each drum having an open end;

supplying fresh air via a single channel to a separate and additional compartment that extends across the open ends of the drums in the dryer chamber;

mixing the fresh air with the drying air inside the separate and additional compartment, after the drying air passes through the fabric web; and flowing the heated drying air mixed with the fresh air through the fabric web and discharging exhaust air first via an interior chamber of the drum, and then via a single channel from the separate and additional compartment.

12. The method of drying a textile fabric web according to claim 11, wherein the supplying step includes supplying the fresh air to the separate and additional compartment in a region of an outlet of the fabric web and the discharging step includes discharging the exhaust air from the additional compartment in a region of an inlet of the fabric web.

13. The method of drying a textile fabric web according to claim 11, further comprising withdrawing a mass sub-flow of exhaust air from the drying air and supplying a mass sub-flow of fresh air to the drying air.

14. The method of drying a textile fabric web according to claim 13, including removing the exhaust air from the drying air at a location at which the drying air has its lowest temperature level or energy level.

15. The method of drying a textile fabric web according to claim 11, further comprising heating the fresh air and the drying air inside the heating and fan chamber.

16. The method of drying a textile fabric web according to claim 15, wherein the heating of the fresh air and the drying air is effected by one of a heat exchanger, a gas burner, or an electric heater.

17. The method of drying a textile fabric web according to claim 11, including heating the fresh air before flowing into the separate and additional compartment.

* * * * *